US009962709B2

(12) United States Patent
Van Zyl

(10) Patent No.: US 9,962,709 B2
(45) Date of Patent: May 8, 2018

(54) METHOD AND APPARATUS FOR SEPARATING MAGNETIC MATERIAL FROM A SLURRY

(71) Applicant: STEINERT AUSTRALIA PTY LTD, Bayswater, Victoria (AU)

(72) Inventor: Johannes Willem Van Zyl, Park Orchards (AU)

(73) Assignee: STEINERT AUSTRALIA PTY LTD, Bayswater, Victoria (AU)

( * ) Notice: Subject to any disclaimer, the term of this patent is extended or adjusted under 35 U.S.C. 154(b) by 403 days.

(21) Appl. No.: 14/782,564

(22) PCT Filed: Apr. 4, 2014

(86) PCT No.: PCT/AU2014/000362

§ 371 (c)(1),
(2) Date: Oct. 5, 2015

(87) PCT Pub. No.: WO2014/161040

PCT Pub. Date: Oct. 9, 2014

(65) Prior Publication Data

US 2016/0030947 A1 Feb. 4, 2016

(30) Foreign Application Priority Data

Apr. 5, 2013 (AU) ..... 2013202569

(51) Int. Cl.
*B03C 1/14* (2006.01)
*B03C 1/22* (2006.01)
*B03C 1/247* (2006.01)

(52) U.S. Cl.
CPC ..... *B03C 1/14* (2013.01); *B03C 1/22* (2013.01); *B03C 1/247* (2013.01); *B03C 2201/18* (2013.01)

(58) Field of Classification Search
CPC .. B03C 1/14; B03C 1/22; B03C 1/247; B03C 2201/18
See application file for complete search history.

(56) References Cited

U.S. PATENT DOCUMENTS 2,564,515 A 8/1951 Vogel
5,496,470 A 3/1996 Lenhart

FOREIGN PATENT DOCUMENTS

AU 2006220430 A1 4/2007
GB 1051794 A 12/1966

OTHER PUBLICATIONS

The Written Opinion of the International Searching Authority for PCT/AU2014/000362, dated Apr. 24, 2014.*

(Continued)

*Primary Examiner* — David A Reifsnyder
(74) *Attorney, Agent, or Firm* — Alston & Bird LLP

(57) ABSTRACT

A method and apparatus for separating magnetic material from a slurry is disclosed, the method including the steps of providing a first moving surface, depositing the slurry onto the first moving surface, attracting at least a portion of the magnetic material of the slurry onto the first moving surface by first magnetic means, arranging the first moving surface such that liquid from the slurry is removed due to the portion of the magnetic material being attracted to the moving surface by the first magnetic means to form a magnetic material cake, separating an inner portion of the magnetic material cake from an outer portion of the magnetic material cake, with respect to the first moving surface, such that the inner portion has a lower liquid content than the outer portion.

26 Claims, 2 Drawing Sheets

(56) References Cited

OTHER PUBLICATIONS

International Searching Authority, International Search Report for International Application No. PCT/AU2014/000362, dated Apr. 24, 2014, 4 pages, Australian Patent Office, Australia.

* cited by examiner

METHOD AND APPARATUS FOR SEPARATING MAGNETIC MATERIAL FROM A SLURRY

CROSS REFERENCE TO RELATED APPLICATIONS

This application is a National Stage Application, filed under 35 U.S.C. § 371, of International Application No. PCT/AU2014/000362 filed Apr. 4, 2014, which claims priority to Australian Patent Application No. 2013202569, filed Apr. 5, 2013, the contents of both of which as are hereby incorporated by reference in their entirety.

BACKGROUND

Related Field

The present invention is directed to a method of and apparatus for separating magnetic material from a slurry, and, in particular, for separating magnetite from a slurry.

Description of Related Art

Magnetic material, such as magnetite, is often produced in a slurry, usually with water. For transportation the slurry requires to have a significant proportion of liquid removed, forming a cake, as excess liquid means that additional weight is transported and, in addition, can move undesirably during transportation. The magnetic material cake cannot be to dry it then becomes dusty and can be difficult to work with. This process is generally known as dewatering when water is the liquid in the slurry.

Conventional methods of dewatering, include the use of thickeners or clarifiers, followed by a filtration system. The filtration systems may include belt filters, vacuum disk filters or filter presses.

Traditionally, thickeners consist of a large circular tank that is used to settle out solid material from liquid in the feed slurry using gravity. These traditional thickeners take up a very large area, require a large support structure and, subsequently, require a large capital outlay. In addition, failures in the drive or feed apparatus may result in a complete plant stoppage. Similar disadvantages apply to the belt, disk or press filters.

Improvements in the field of thickeners or clarifiers include the use of magnetic dewatering drum thickeners. These thickeners are typically made of a drum that is rotatably mounted on a shaft. The slurry is then fed past the rotating drum that includes a magnet assembly on the inner drum wall. The slurry may then be separated as the magnetic material is attracted towards the drum wall and collected as the drum rotates, resulting in a concentration of the magnetic material. Meanwhile, liquid is collected by another outlet after falling away from the drum.

Drum thickeners can accept concentrates with reduced pre-processing, such as magnetite concentrates, directly from a beneficiation plant. Drum thickeners can also produce higher concentrates than a traditional tank thickener.

If low-intensity magnets are used in drum thickeners, the typical concentrations of the magnetic material may be 69% solids w/w. However, high losses of magnetic material may occur.

The use of higher-intensity magnets can result in the increase of concentrations of wet slurries to typical values of 85% solids w/w, reducing the loss of magnetic material. However, there may still be a total loss of a possible 1% of magnetic material.

As an example of prior art, Australian patent application AU 2006220430 is directed to a drum thickener for dewatering magnetite concentrates. This process includes that a slurry of magnetite and water is fed into a trough or vessel provided with a rotating drum of non-magnetic material. A magnet is fixed at a low point of the drum and attracts the magnetic component of the slurry which then attaches to the surface of the drum. The magnetic material then accumulates on the drum which eventually is detached from the drum by a scraper and is collected at an outlet. Water is not attracted to the drum and is eventually removed from the vessel by another outlet.

Typically for the purposes of shipping and transportation, and for conveyance and stockpiling, and perhaps as a precondition to pelletising, it is preferable that the magnetite have a transportable moisture limit (TML) of 5-8% (92-95% solids w/w). As mentioned above, the drum thickener as described in AU2006220430 is only capable of achieving around 85% solids w/w. Although, AU2006220430 describes achieving a water content not exceeding 10% by weight, this is still insufficient for the transportable moisture limit of 5-8% and, in practice, has not been achievable.

BRIEF SUMMARY

According to a first aspect of the present invention, there is provided a method of separating magnetic material from a slurry, the method including the steps of:

providing a first moving surface;

depositing the slurry onto the first moving surface;

attracting at least a portion of the magnetic material of the slurry onto the the first moving surface by first magnetic means;

arranging the first moving surface such that liquid from the slurry is removed due to the portion of the magnetic material being attracted to the moving surface by the first magnetic means to form a magnetic material cake;

separating an inner portion of the magnetic material cake from an outer portion of the magnetic material cake, with respect to the first moving surface, such that the inner portion has a lower liquid content than the outer portion. This allows the advantage of easily producing a magnetic material with a lower average liquid content than has been achieved by conventional means.

Preferably, a bladed means separates the inner portion from the outer portion of the magnetic material cake. More preferably, the method may include directing a jet of air to separate the inner portion from the outer portion of the magnetic material cake. The knife or blade means may further include a hollow channel or portion for directing the jet of air. Even more preferably, the bladed means and/or the jet of air may be adjustable for varying the liquid content of the inner portion and the inner portion of the magnetic material cake may have a liquid content of 5-8%. These features provide the advantage to allow that the separation of portions of the magnetic material cake that are of the appropriate liquid level preferable for transport or as a precursor to pelletisation.

As an embodiment, the outer portion of the magnetic material cake may be returned to the first moving surface for further separation. This ensures that the magnetic material with high liquid content can be reprocessed efficiently for further liquid removal.

Further, the method may include at least one spray nozzle for directing liquid onto the first moving surface to remove silica from the magnetic material cake. This allows the removal of silica from the magnetic material cake so that the inner portion of the magnetic material cake has a lower content of silica and attracts a higher market value.

A further embodiment of the method includes the steps of:

depositing the liquid from the slurry onto a second moving surface;

attracting at least a portion of residual magnetic material of the liquid onto the second moving surface by a second magnetic means:

arranging the second moving surface such that the liquid is removed due to at least a portion of the residual magnetic material being attracted to the second moving surface by the second magnetic means. This allows the reprocessing of the liquid of the slurry to recover any residual magnetic material that may remain.

The residual magnetic material may then be returned to the first moving surface for further processing. This allows that the residual magnetic material can be then reprocessed to produce a magnetic material of the appropriate liquid level.

As a preferred embodiment, the first and/or second moving surface is a surface of a rotating drum. Alternatively, the first and/or second moving surface is a surface of at least one belt. The advantage of using rotating drums or belt systems is that they are smaller, take up less area and require a lesser capital outlay than conventional systems.

The first and/or second magnetic means may be a permanent magnet including rare earth magnets. Rare earth magnets are preferred for producing a high magnetic field intensity in a compact arrangement.

According to an alternative aspect of the present invention, there is provided an apparatus for separating magnetic material from a slurry, the apparatus including:

a first moving surface including first magnetic means;

the first moving surface arranged such that liquid from the slurry is removed due to the portion of the magnetic material being attracted to the first moving surface by the first magnetic means to form a magnetic material cake; and separation means arranged such that an inner portion of the magnetic material cake is separated from an outer portion of the magnetic material cake, with respect to the first moving surface, wherein the inner portion has a lower liquid content than the outer portion. This allows the advantage of easily producing a magnetic material with a lower average liquid content than has been achieved by conventional means.

Preferably, the apparatus includes bladed means for separating the inner portion from the outer portion of the magnetic material cake and the bladed means may be adjustable for varying the liquid content of the inner portion. The apparatus may also include a jet of air for separating the inner portion from the outer portion of the magnetic material cake. The jet of air may also be adjustable. Preferably, the knife or blade means include a hollow channel or portion for directing the jet of air. Even more preferably, inner portion of the magnetic material cake has a liquid content of 5-8%. These features provide the advantage to allow that the separation of portions of the magnetic material cake that are of the appropriate liquid level preferable for transport or as a precursor to pelletisation. The outer portion of the magnetic material cake may be returned to the first moving surface for further separation. This ensures that the magnetic material with high liquid content can be reprocessed efficiently for further liquid removal.

The apparatus may further include:

a second moving surface with second magnetic means wherein the second moving surface is arranged to receive the liquid from the slurry and to attract at least a portion of residual magnetic material from the liquid onto the second moving surface by the second magnetic means and wherein the second moving surface is further arranged such that the liquid is removed due to at least a portion of the residual magnetic material being attracted to the second moving surface by the second magnetic means. This allows the reprocessing of the liquid of the slurry to recover any residual magnetic material that may remain.

Further, the apparatus is arranged such that the residual magnetic material is returned to the first moving surface for further processing. This ensures that the magnetic material with high liquid content can be reprocessed efficiently for further liquid removal and is not wasted.

The apparatus may also include at least one spray nozzle for directing liquid onto the first moving surface to remove silica from the magnetic material cake. This facilitates the removal of silica and produces a purer form of magnetic material cake.

Preferably, the first and/or second moving surface may be a surface of a rotating drum or first and/or second moving surface may be a surface of at least one belt. The advantage of using rotating drums or belt systems is that they are smaller, take up less area and require a lesser capital outlay than conventional systems.

The apparatus may further include that the first and/or second magnetic means is a permanent magnet including rare earth magnets. Rare earth magnets are preferred for producing a high magnetic field intensity in a compact arrangement.

BRIEF DESCRIPTION OF THE FIGURES

In order that the present invention may be more readily understood, preferred embodiments thereof will now be described, by way of example only, with reference to the accompanying drawings, in which.

DETAILED DESCRIPTION OF VARIOUS EMBODIMENTS

Figure 1:
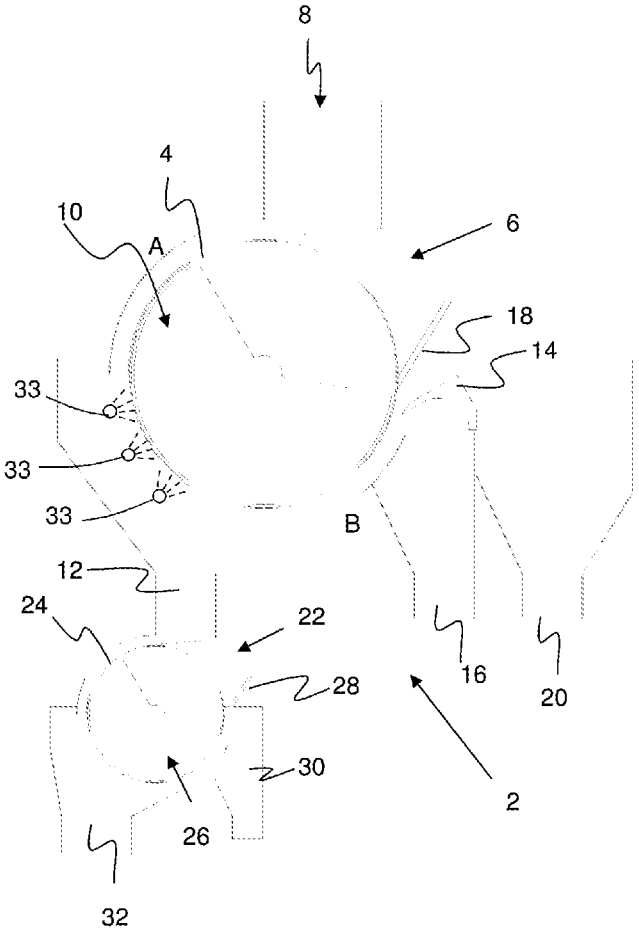
FIG. 1 shows a top view of an apparatus for separating magnetic material from a slurry in a rotating drum system, according to a first embodiment of the invention.
Figure 2:
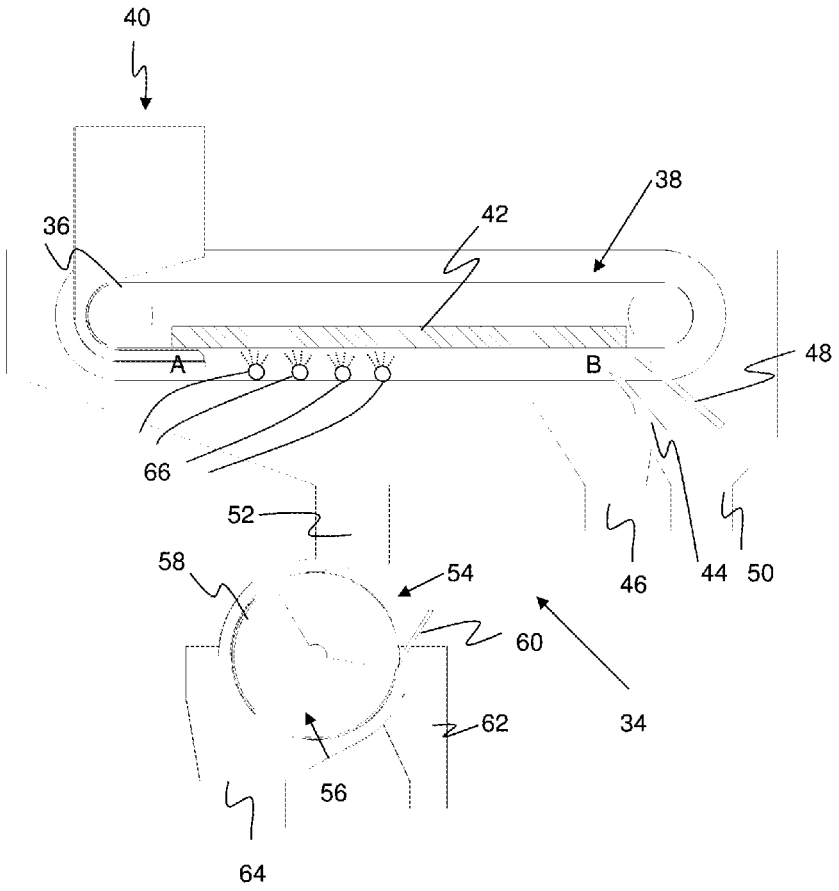
FIG. 2 shows a top view of an apparatus for separating magnetic material and slurry in a belt system according to a second embodiment of the invention.

Referring to FIGS. 1 and 2, there is shown two apparatuses for separating magnetic material from a slurry according to preferred embodiments of the invention. These particular embodiments are directed to a slurry of magnetite and water, although the embodiments are equally applicable to slurries of other magnetic materials and other liquids. For example, these apparatuses could apply to the recovery of scale from the production of steel.

In general, the apparatuses 2, 34 include a first moving surface 4, 36 which conveys the slurry. In FIG. 1, the first moving surface 4 is the outer surface of a rotating drum and, in FIG. 2, the first moving surface 36 is the outer surface of a conveyor belt. On the opposite side of, at least, a portion of the first moving surface 4, 36 is a first magnetic means 10, 56. The first magnetic means 10, 56 can be, for example, one or more permanent magnets or one or more electromagnets, but will be referred to as a first magnet for simplicity. When the slurry passes over a portion of the first moving surface 4, 36 where the first magnet 10, 56 is situated, the first magnet 10, 56 attracts any magnetic material, including the magnetite, in the slurry and, thus, the magnetite is attracted to the first moving surface 4, 36.

Any non-magnetic material, which in these embodiments is, generally, water, is not attracted to the first moving surface 4, 36 around the drum 6 or belt 38. The drum 6 or belt 38 is arranged such that the moving surface 4, 36 allows the non-magnetic material to be removed from the magnetic material under the influence of gravity. That is, the magnetite is attracted to the first magnet 10, 56 sufficiently to, substantially, overcome the force of gravity. Typical magnetic field strengths suitable for this purpose are in the range of $7\times10^3$ Gauss to $8\times10^3$ Gauss, although higher magnetic field strengths are preferable. The non-magnetic material, which is water in this embodiment, drains from the magnetite under the influence of gravity and is discharged at a first outlet 12, 52.

The magnetite is drained of, at least, some of the water such that a cake of magnetite is accumulated on the moving surface 4, 36. This cake of magnetite, typically, has 15% by weight of water, even when optimised with strong magnets. As the magnetite moves with the first moving surface 4, 36, the cake of magnetite reaches a first separating means 14, 44, which in this case is a blade which separates an inner portion of the cake of magnetite, which is closer to the first moving surface 4, 36, from an outer portion of the cake of magnetite.

The cake of magnetite varies in the amount of water by weight contained therein, as the distance from the first moving surface 4, 36 varies. That is, the cake of magnetite contains less water closer to the moving surface 4, 36, and more water further from the first moving surface 4, 36. This is due to the diminishing effect of the magnetic field intensity at increasing distances from the surface the first magnet 10, 56, and the ability of the water to easily drain from the magnetite.

The separation means 14, 44 achieves initial separation of the outer portion of the cake of magnetite, containing a higher proportion of water, which is then collected at a second outlet 16 and returned to the feed box or inlet 8, 40, in a feedback loop. The inner portion of the cake of magnetite collected by a scraper 18, 48 is deposited into at a third outlet 50. The point at which the separation means 14, 44 separate the inner portion and outer portion is selected such that the inner portion has a desired percentage of water. The inner portion can, thus, be de-watered at an appropriate Transportable Moisture Limit (TML). This ensures that the cake of magnetite is output, via the third outlet 50, at an appropriate liquid or moisture level.

The position and angle of the blade or knife means 14, 44 can be adjustable to produce the appropriate percentage weight of water in the cake of magnetite. Typically, the blade or knife means is a wedge shaped member with the point of the wedge being arranged towards the magnetite cake as it moves around the drum or belt. The material of the knife or blade means 14, 44 is, preferably, a wear-resistant material appropriate to the application of the present invention.

A jet of pressurised air (not shown) may also be directed towards the drum and functions to provide additional separation of inner and outer portion of the magnetite cake on the drum 6. This jet may be used in conjunction with the knife and blade means 14 and is aligned substantially along the axis of the knife or blade means. The pressurised air functions to reduce the wear and tear on the knife and blade means 14. The force and angle of the pressurised air jet is adjustable to aid the appropriate percentage weight of water in the cake of magnetite.

As a further alternative, the blade or knife means 14 may include a hollow channel or portion (not shown). This hollow channel would be capable of directing the jet of pressurised air within the blade or knife means 14 onto the drum 6. The hollow channel or portion is at least partially aligned along the longitudinal axis of the knife or blade means 14.

It is then possible to direct the liquid water discharge expelled at the first outlet to a second moving external surface 24, 58 of a second drum 22, 54, where a second magnetic means 26, 56 located within the drum, 22, 54, attracts the residual magnetite contained in the liquid discharge. The second moving surface 24, 58 may also be a belt. Similarly, the non-magnetic material or water will not be attracted to the drum 22, 54, and is discharged at an outlet 32. The residual magnetite is then carried by the second moving surface 24, 58 of the second drum 22, 54, to the second scraper 28, 60 for collection at outlet 30, 62. The residual magnetic material may then be returned to the first feed box or inlet, 8, 40 for further de-watering, or, if sufficiently dry be output to the third outlet 50.

Due to the lower concentration of residual magnetite discharged at outlet 12, the second magnetic means 26, 56 may have a higher magnetic field intensity to aid the recovery process. This may be achieved using rare earth magnets including neodymium iron boron or samarium cobalt.

In FIG. 1, this embodiment shows the apparatus 2 where the moving surface 4 is an external surface of a rotating drum 6. The slurry is fed onto the moving surface 4 through an inlet such as a feed box 8 and passes along the surface 4 of the drum 6.

A stationary and permanent magnet 10 is located within the external surface of the drum 6, and is shaped to conform to the surface 4 of the drum 6, as shown in FIG. 1. The slurry passes over the surface 4, and the magnetic material is attracted to the magnet 10 initially at point A and is rotated in an anti-clockwise direction towards point B, forming a cake of magnetite. The non-magnetic material of the slurry, including liquid or water, is not attracted to the magnet 10 and thus is discharged at the first outlet 12.

Beyond point B, the magnetic material cake is separated into two parts, by the knife or blade means 14 as the cake is moved along the surface 4 of the drum 6. The knife or blade means 14 removes the outer portion of the cake of magnetite on the surface of the drum 6 that is further out from magnet 10 and which contains more liquid per weight than an inner portion of the cake of magnetite closer to the magnet 10. The knife or blade means 14 is, preferably adjustable to change the depth, relative to the moving surface 4, at which the inner portion is separated from the outer portion. This allows selection of the desired percentage of liquid in the cake of magnetite. The less dense or more liquid outer portion of the cake of magnetite is then collected at a second outlet 16. The outer portion of the cake of magnetite at outlet 16 can collected and returned to the inlet or feed box 8 for further processing by assembly 2 by a pump or other means. The inner portion of the cake of magnetite is moved further along the drum 6, and is removed from the surface 4 by a scraper 18, and then is discharged at a third outlet 20. This inner portion of cake of magnetite at the third outlet 20 should now be at an appropriate average TML level of 5-8% for transport and further processing.

This apparatus provides for the collection of a magnetite with a lower average percentage of water. The outer portion of cake of magnetite, which contains a higher percentage of water, may be then pumped or otherwise transported to the feed box or inlet 8 for further processing.

It is expected that any non-magnetic material, such as water, discharged at outlet 12 may still have residual magnetite. A second drum 22 with a second moving surface 24 and magnetic means 26 may be provided to further remove this magnetite from the discharge at the first outlet 12, in a similar way to the drum 6. A belt system may be substituted for the second drum 22, as required. Similarly, the liquid discharge is fed onto the second moving external surface 24 of the drum 22, and any residual magnetite is then attracted to the magnetic means 26 of at least one permanent magnet which conforms to the surface of the drum 22. The magnetite is then scraped off the surface 24 of the drum 22 by a second scraper 28 and collected at outlet 30, and may be returned to the inlet or feed box 8 for further processing. The waste non-magnetic material or liquid discharge, not attracted by the second magnetic means 26, is finally expelled at outlet 32.

A set of spray nozzles 33 is provided near the drum 6 between point A and B may direct liquid onto the magnetite cake on the moving surface 4 of the drum 6. It has been found that liquid such as water directed onto the magnetite cake also reduces the amount of silica present in the inner portion of recovered magnetite.

The typical amount of silica present in the pre-processed magnetite slurry is approximately 3.5%. During trials of prototype assemblies, this concentration of silica in the inner portion of the cake of magnetite was found to be reduced to 2.5%. It is expected that silica removal rates of 2% or higher are achievable with this method. Thus the inner portion of the cake of magnetite recovered at outlet 20 has a lower concentration of silica than the magnetite slurry deposited at feed box 8. This represents a purer form of magnetite cake and thus attracts a higher market value.

In FIG. 2, this alternate embodiment of the present invention shows the apparatus 34 where the first moving surface 36 is a external surface of a revolving belt 38, which accepts the stream of slurry from the inlet or feed box 40. The magnetite in the slurry is attracted to the first magnetic means 42, which may be a rectangular permanent magnet, at point A, and is then moved by the belt 38 towards point B.

The magnetite at point B will be caked on the surface 36 of the belt 38, and as described above, varies in water content across its depth, such that an inner portion of drier magnetite is closer to the surface 36 of the belt 38, and a wetter outer portion of magnetite is further from the surface 36 of the belt 38. The blade or knife means 44 separates the outer portion of the cake of magnetite and directs this outer portion to a second outlet 46, while the inner portion of cake of magnetite is removed from the belt 38 by a first scraper 48 and collected at a third outlet 50. The cake of magnetite at outlet 50 should be at an appropriate average TML level of 5-8% for transport and further processing. The outer portion of cake of magnetite at outlet 46 can collected and returned to the inlet or feed box 40 for further processing by assembly 34 by a pump or other means.

Similarly to FIG. 1, a jet of pressurised air (not shown) may also be directed towards the belt 38 to provide additional separation of inner and outer portion of the magnetite cake on the belt 38. This jet may be used in conjunction with the knife and blade means 44 and is aligned substantially along the axis of the knife or blade means 44. The pressurised air functions to reduce the wear and tear on the knife and blade means 44. The force and angle of the pressurised air jet is adjustable to aid the appropriate percentage weight of water in the cake of magnetite.

Alternatively, the blade or knife means 44 may include a hollow channel or portion (not shown). This hollow channel would be capable of directing the jet of pressurised air within the blade or knife means 44 onto the belt 38. The hollow channel or portion is at least partially aligned along the longitudinal axis of the knife or blade means 44.

Similarly to the rotating drum apparatus of FIG. 1, it is expected that any non-magnetic material or liquid, such as water, discharged at outlet 52 may still have residual magnetite. A rotating drum 54 with a second moving surface 56 and second magnetic means 56 may be provided to further remove this residual magnetite from the liquid discharge at the first outlet 52, in a similar way to the drum 22, of FIG. 1. A belt system may be substituted for the second drum 54, as required. The liquid discharge is fed onto the second moving external surface 58 of the drum 54, and any residual magnetite is then attracted to the second magnetic means of at least one permanent magnet, possibly a rare earth magnet 56 which conforms to the surface of the drum 54. The residual magnetite is then scraped off the second moving surface 58 of the drum 54 by a second scraper 60 and collected at outlet 30, and may be returned to the inlet or feed box 40 for further processing. The waste non-magnetic material or liquid discharge, not attracted by the second magnetic means 56, is finally expelled at outlet 64.

Similarly to the spray nozzles 33 of FIG. 1, there are provided spray nozzles 66 provided near the belt 38 between point A and B that may direct liquid such as water onto the moving surface 36 of the belt 38 of FIG. 2. The spray of water allows the silica to be removed from the cake of magnetite such that the concentration of silica is lower at the inner portion of the cake of magnetite recovered at outlet 50.

Although several spray nozzles 33, 66 are shown in FIG. 1 or 2, it can be understood that only one spray nozzle may be necessary to carry out the required function by the skilled artisan.

Further modifications and improvements may be made without departing from the scope of the present invention. For example, the configuration and materials of the separation means such as the knife or blade means may be of any suitable and appropriate material or configuration, as would be known from common general knowledge to a person skilled in the art. Similarly, the magnetic means may be any known configuration and materials to achieve the magnetic field intensities as needed for the application of the present invention.

In addition, the spray nozzle or nozzles may direct a liquid such as water, but any other liquid could be used that would be considered suitable by a person skilled in the art.

The invention claimed is:

1. A method of separating magnetic material from a slurry, the method comprising the steps of:

providing a first moving surface;

depositing the slurry onto the first moving surface;

attracting at least a portion of the magnetic material of the slurry onto the first moving surface by first magnetic means;

arranging the first moving surface such that liquid from the slurry is removed due to the portion of the magnetic material being attracted to the moving surface by the first magnetic means to form a magnetic material cake; and separating an inner portion of the magnetic material cake from an outer portion of the magnetic material cake, with respect to the first moving surface, such that the inner portion has a lower liquid content than the outer portion.

2. A method according to claim 1, wherein the step of separating comprises the sub-steps of:

providing at least one of a blade or a knife means; and arranging the blade or knife means to separate the inner portion from the outer portion of the magnetic material cake.

3. An apparatus according to claim 2, wherein the knife or blade means comprises at least one of a hollow channel or a hollow portion for directing a jet of air.

4. A method according to claim 3, wherein at least one of the blade means, the knife means, or the jet of air is adjustable for varying the liquid content of the inner portion.

5. A method according to claim 1, wherein the step of separating comprises directing a jet of air to separate the inner portion from the outer portion of the magnetic material cake.

6. A method according to claim 1, wherein the inner portion of the magnetic material cake has a liquid content in a range of 5-8%.

7. A method according to claim 1, wherein the outer portion of the magnetic material cake is returned to the first moving surface for further processing.

8. A method according to claim 1, further comprising at least one spray nozzle for directing liquid onto the first moving surface to remove silica from the magnetic material cake.

9. A method according to claim 1, further comprising the steps of:

depositing the liquid from the slurry onto a second moving surface;

attracting at least a portion of residual magnetic material of the liquid onto the second moving surface by a second magnetic means; and arranging the second moving surface such that the liquid is removed due to at least a portion of the residual magnetic material being attracted to the second moving surface by the second magnetic means.

10. A method according to claim 9, wherein the residual magnetic material is returned to the first moving surface for further processing.

11. A method according to claim 9, wherein at least one of the first or the second moving surfaces is a surface of a rotating drum.

12. A method according to claim 9, wherein at least one of the first or the second moving surfaces is a surface of at least one belt.

13. A method according to claim 9, wherein at least one of the first or the second magnetic means is a permanent magnet including rare earth magnets.

14. An apparatus for separating magnetic material from a slurry, the apparatus comprising:

a first moving surface comprising first magnetic means;

the first moving surface arranged such that liquid from the slurry is removed due to the portion of the magnetic material being attracted to the first moving surface by the first magnetic means to form a magnetic material cake; and separation means arranged such that an inner portion of the magnetic material cake is separated from an outer portion of the magnetic material cake, with respect to the first moving surface, wherein the inner portion has a lower liquid content than the outer portion.

15. An apparatus according to claim 14, wherein the separation means comprises at least one of a blade means or a knife means for separating the inner portion from the outer portion of the magnetic material cake.

16. An apparatus according to claim 15, wherein the knife or blade means comprises at least one of a hollow channel or a hollow portion for directing a jet of air.

17. An apparatus according to claim 16, wherein at least one of the blade means, the knife means, or the jet of air is adjustable for varying the liquid content of the inner portion.

18. An apparatus according to claim 14, wherein the separation means comprises a jet of air for separating the inner portion from the outer portion of the magnetic material cake.

19. An apparatus according to claim 14, wherein the inner portion of the magnetic material cake has a liquid content in a range of 5-8%.

20. An apparatus according to claim 14, wherein the outer portion of the magnetic material cake is returned to the first moving surface for further separation.

21. An apparatus according to claim 14, further comprising at least one spray nozzle for directing liquid onto the first moving surface to remove silica from the magnetic material cake.

22. An apparatus according to claim 14, further comprising:

a second moving surface with second magnetic means, wherein:

the second moving surface is configured to receive the liquid from the slurry and to attract at least a portion of residual magnetic material from the liquid onto the second moving surface by the second magnetic means; and the second moving surface is further configured such that the liquid is removed due to at least a portion of the residual magnetic material being attracted to the second moving surface by the second magnetic means.

23. An apparatus according to claim 22, wherein the residual magnetic material is returned to the first moving surface for further processing.

24. An apparatus according to claim 22, wherein at least one of the first or the second moving surfaces is a surface of a rotating drum.

25. An apparatus according to claim 22, wherein at least one of the first or the second moving surfaces is a surface of at least one belt.

26. An apparatus according to claim 22, wherein at least one of the first or the second magnetic means is a permanent magnet including rare earth magnets.

* * * * *